US007614261B2

(12) United States Patent
Oh et al.

(10) Patent No.: US 7,614,261 B2
(45) Date of Patent: Nov. 10, 2009

(54) DRUM TYPE WASHING MACHINE

(75) Inventors: Je Jun Oh, Seoul (KR); Hyoung Hoon Roh, Suwon-Si (KR); Jung Ho Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 475 days.

(21) Appl. No.: 11/209,656

(22) Filed: Aug. 24, 2005

(65) Prior Publication Data

US 2006/0117808 A1 Jun. 8, 2006

(30) Foreign Application Priority Data

Dec. 2, 2004 (KR) ..... 10-2004-0100604

(51) Int. Cl.
*D06F 25/00* (2006.01)

(52) U.S. Cl. ..... 68/19.1; 68/20

(58) Field of Classification Search ..... 68/3 R, 68/19, 19.2, 20, 208, 19.1
See application file for complete search history.

(56) References Cited

U.S. PATENT DOCUMENTS 3,103,112 A * 9/1963 Behrens et al. ..... 68/18 R
3,106,831 A * 10/1963 Behrens ..... 68/12.08
2003/0200773 A1* 10/2003 Hong et al. ..... 68/20
2004/0163422 A1* 8/2004 Kim et al. ..... 68/12.05
2004/0194514 A1 10/2004 No et al.

FOREIGN PATENT DOCUMENTS

| | | | |
|---|---|---|---|
| GB | 1 461 073 | A | 1/1977 |
| GB | 2 387 895 | A | 10/2003 |
| JP | 2002-153695 | A | 5/2002 |
| JP | 2004/008543 | A | 1/2004 |
| KR | 10-0441096 | B1 | 7/2003 |
| KR | 10-2004-0046951 | A | 6/2004 |
| KR | 10-2004-0061155 | A | 7/2004 |

OTHER PUBLICATIONS

Electronic translation of JP 2004/008543.*
Japanese Abstract No. 2004008543, dated Jan. 15, 2004.

* cited by examiner

*Primary Examiner*—Joseph L Perrin
(74) *Attorney, Agent, or Firm*—Sughrue Mion, PLLC

(57) ABSTRACT

A drum type washing machine includes a water tub adapted to contain wash water therein, and the water tub has first and second vent holes to circulate air to and from the water tub. The first vent hole is positioned higher than the second vent hole. Thereby, outside air is introduced into the water tub via the second vent hole, and interior air of the water tub is discharged to the outside of the water tub via the first vent hole, thereby allowing the relative humidity inside the water tub to be effectively lowered by virtue of air circulation.

5 Claims, 4 Drawing Sheets

DRUM TYPE WASHING MACHINE

CROSS-REFERENCE TO RELATED APPLICATION

This application claims the benefit of Korean Patent Application No. 2004-100604, filed on Dec. 2, 2004 in the Korean Intellectual Property Office, the disclosure of which is incorporated herein by reference.

BACKGROUND OF THE INVENTION

1. Field of the Invention

The present invention relates to a drum type washing machine, and, more particularly, to a drum type washing machine capable of effectively lowering a relative humidity inside a water tub within a short time.

2. Description of the Related Art

Generally, a drum type washing machine is an apparatus that repeatedly performs a wash cycle, rinse cycle, etc to wash laundry. In such a drum type washing machine, laundry is raised and subsequently falls down to be washed by virtue of an impact applied thereto when it falls down.

A conventional drum type washing machine, as disclosed in Korean Patent Laid-Open No. 10-2004-61155, comprises a housing forming an external appearance of the washing machine, a cylindrical water tub mounted in the housing and adapted to contain wash water, a rotating tub rotatably mounted in the water tub, a drive motor mounted at the rear side of the water tub and adapted to produce a driving force required to rotate the rotating tub, and a rotating shaft penetrating through the water tub to transmit the driving force of the drive motor to the rotating tub to thereby enable rotation of the rotating tub.

The rotating tub has a single vent hole perforated at a rear region thereof for the inflow or outflow of air. The vent hole serves to lower a relative humidity inside the water tub.

In the case of the conventional drum type washing machine, however, since the vent hole permits only a very small inflow or outflow of air, it takes a considerably long time to dry the interior of the water tub using the vent hole. Even in the initial stage of drying, adversely, moisture inside the water tub evaporates, increasing the relative humidity inside the water tub.

SUMMARY OF THE INVENTION

The present invention has been made to solve the above mentioned problems, as well as other problems not discussed above.

An apparatus consistent with the present invention provides a drum type washing machine capable of effectively lowering a relative humidity inside a water tub within a short time.

In accordance with one aspect, the present invention provides a drum type washing machine comprising a water tub adapted to contain wash water therein, wherein the water tub comprises a plurality of vent holes to circulate air to and from the water tub, at least one of the vent holes being positioned higher than the other vent hole.

The plurality of vent holes may include a first vent hole and a second vent hole, the first vent hole being positioned higher than the second vent hole.

The first and second vent holes may be formed at first ends of first and second connection pipes connected to the water tub at their second ends, respectively.

The second connection pipe may be a suction pipe to introduce outside air into the water tub, and the first connection pipe may be a discharge pipe to discharge interior air of the water tub to the outside.

The second end of the second connection pipe, connected to the water tub, may be positioned lower than the first vent hole.

The height difference between the first and second vent holes may be in a range of 80 to 120 mm.

The diameter of the first and second vent holes may be substantially 70 mm.

In accordance with one aspect, the present invention provides a drum type washing machine comprising: a water tub adapted to contain wash water therein; and first and second ventilation portions provided at the water tub and adapted to circulate outside air to and from the water tub, the first ventilation portion being positioned higher than the second ventilation portion.

The first and second ventilation portions may include first and second vent holes formed at first ends of first and second connection pipes connected at their second ends to the water tub to communicate with the interior of the water tub.

The second end of the second connection pipe connected to the water tub may be positioned lower than the first vent hole.

The first and second ventilation portions may include first and second vent holes formed at the water tub.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more easily appreciated from the following description of the embodiments, taken in conjunction with the accompanying drawings of which.

DETAILED DESCRIPTION OF THE PREFERRED EMBODIMENTS

Figure 1:
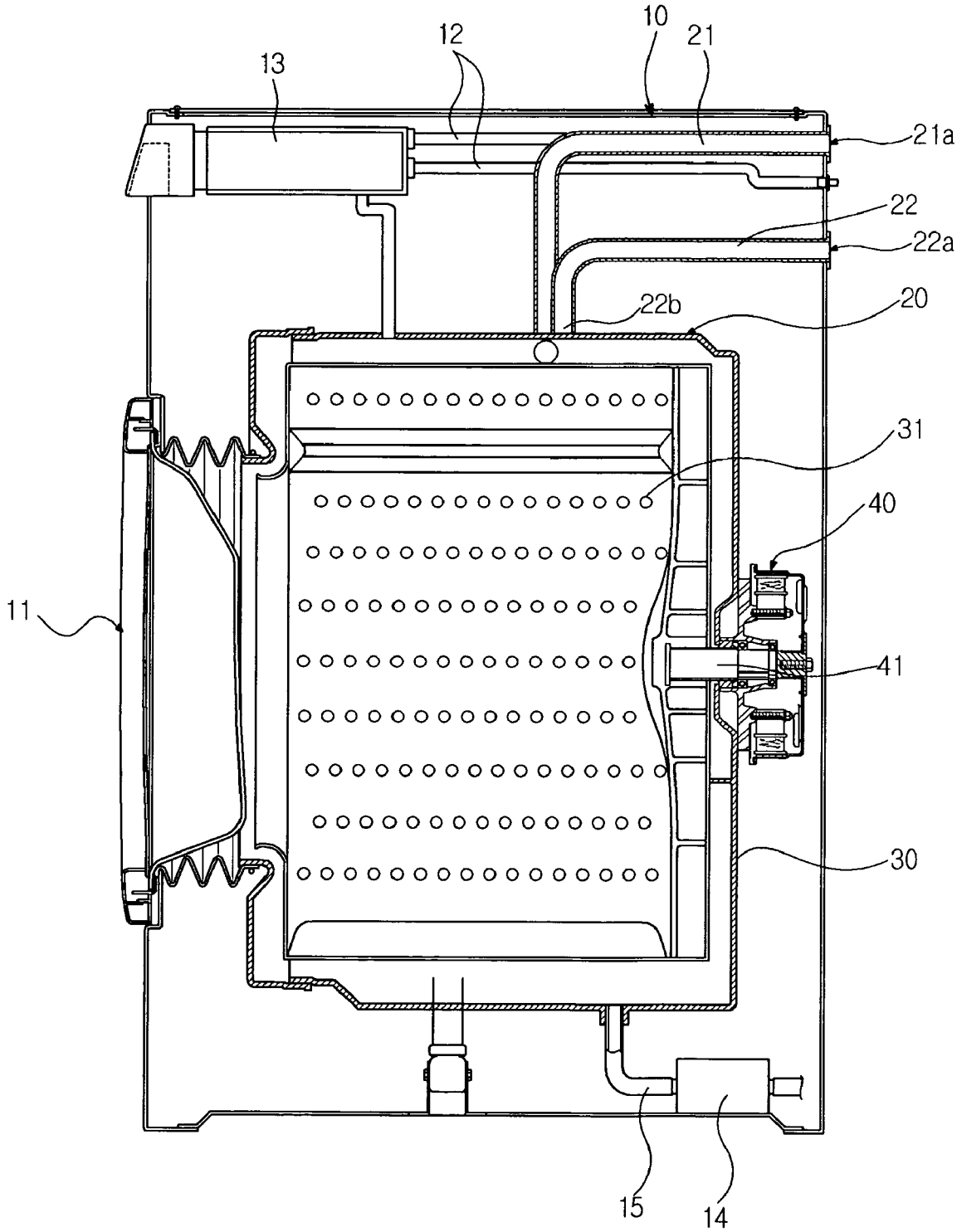
FIG. 1 is a side view of a drum type washing machine in accordance with an exemplary embodiment of the present invention.

Reference will now be made in detail to the embodiments of the present invention, examples of which are illustrated in the accompanying drawings, wherein like reference numerals refer to the like elements throughout.

FIG. 1 illustrates a drum type washing machine in accordance with the present invention. The drum type washing machine comprises a housing 10 forming an external appearance of the washing machine, a water tub 20 mounted in the housing 10 in a suspended state and adapted to contain wash water, and a cylindrical rotating tub 30 rotatably mounted in the water tub 20 and formed with a plurality of dehydrating holes 31 at a circumferential wall thereof. In addition, a drive motor 40 is mounted to a rear end of the water tub 20 outside the water tub 20. A rotating shaft 41 of the drive motor 40 is fixedly coupled to the rotating tub 30 to transmit a rotating force from the drive motor 40 to the rotating tub 30, thereby rotating the rotating tub 30.

The water tub 20 and the rotating tub 30 are formed at their front sides with respective openings to put laundry into or take it out of the rotating tub 30, and a door 11 is hinged at a front side of the housing 10 to open or close the openings of the water tub 20 and the rotating tub 30.

Installed at the top of the housing 10 are a water supply pipe 12 for receiving wash water from an external water supply source, and a detergent container 13 for containing detergent and mixing a detergent with the wash water supplied via the water supply pipe 12. A drainage pump 14 and a drainage hose 15 are installed at the bottom of the housing 10 in order to drain wash water to the outside of the housing 10 after completing washing of laundry.

The drum type washing machine of the present invention further comprises first and second ventilation portions provided at the rear region of an upper end of the water tub 20 to admit circulation of outside air to and from the water tub 20, thereby enabling natural ventilation in the water tub 20.

In the present exemplary embodiment, the first ventilation portion includes an L-shaped first connection pipe 21 extending rearward by a first predetermined length, the connection pipe 21 having a first end affixed to the upper end of the water tub 20 to communicate with the interior of the water tub 20 and a second end forming a first vent hole 21*a*. Similarly, the second ventilation portion includes an L-shaped second connection pipe 22 extending rearward by a second predetermined length and having a first end affixed to the upper end of the water tub 20 to communicate with the interior of the water tub 20 and a second end forming a second vent hole 22*a*.

Here, the first vent hole 21*a* is positioned higher than the second vent hole 22 to cause circulation of outside air through the first and second vent holes 21*a* and 22*a* if a relative humidity inside the water tub 20 is high. More specifically, as a height $H_1$ of the first vent hole 21*a*, measured from the ground surface, is higher than a height $H_2$ of the second vent hole 22*a*, outside air is able to be introduced into the water tub 20 through the second vent hole 22*a*, and interior air of the water tub is able to be discharged through the first vent hole 21*a*.

In such a configuration as stated above wherein the first and second vent holes 21*a* and 22*a* are formed by the second ends of the first and second connection pipes 21 and 22 having the first ends affixed to the water tub 20 to communicate with the water tub 20, the second connection pipe 22 having the second vent hole 22*a* operates as a suction pipe to introduce outside air into the water tub 20, and the first connection pipe 21 having the first vent hole 21*a* operates as a discharge pipe to discharge interior air of the water tub 20 to the outside.

Further, in the present invention, the first end 22*b* of the second connection pipe 22, which is affixed to the water tub 20 to communicate with the water tub 20, has a height $H_2'$ lower than the height $H_1$ of the first vent hole 21*a* to enable continuous circulation of air. The greater a height difference between the first and second vent holes 21*a* and 22*a* and a diameter of the vent holes 21*a* and 22*a*, the greater the efficiency of ventilation in the water tub 20. Preferably, in consideration of sizes of the housing 10 and the water tub 20, the first and second vent holes 21*a* and 22*a* have a diameter of approximately 70 mm, and a height difference of approximately 80 to 120 mm. In the present exemplary embodiment, the diameter of the first and second vent holes 21*a* and 22*a* is 68 mm, and the height difference between the holes is 100 mm.

Figure 2:
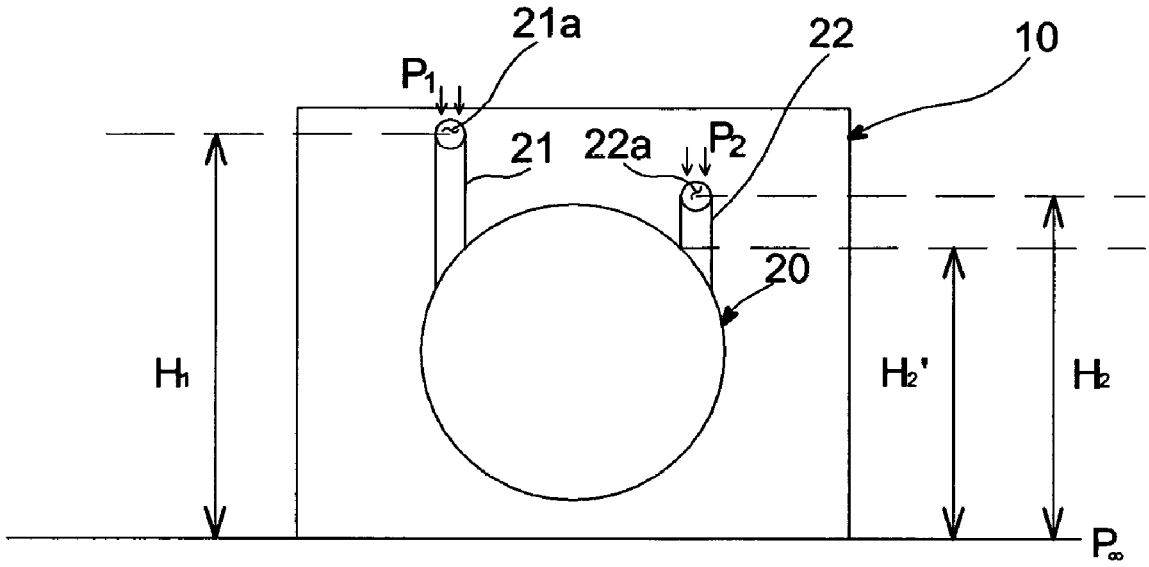
FIG. 2 is a diagram explaining the operating principle of the drum type washing machine in accordance with the present invention.

Now, the principle of natural ventilation in the water tub 20 of the drum type washing machine using the first and second vent holes 21*a* and 22*a* will be explained in detail with reference to FIG. 2.

Initially, as moisture, remaining in the water tub 20, naturally evaporates, the interior of the water tub 20 has a relative humidity higher than that of outside air. The higher the relative humidity, the higher the rate of vapor having a mass smaller than oxygen or nitrogen, resulting in a decrease in the density of air. For this reason, interior air of the water tub 20 has a density lower than the outside air.

Further, according to the present invention, since there exists a height difference between the first and second vent holes 21*a* and 22*a*, different external air pressures are applied to the first and second vent holes 21*a* and 22*a*. As well known, the air pressure increases toward the ground surface and becomes the highest at the ground surface. Thus, the air pressure $P_2$, that is applied to the second vent hole 22*a* located close to the ground surface as compared to the first vent hole 21*a*, is higher than the air pressure $P_1$ that is applied to the first vent hole 21*a* located higher than the second vent hole 22*a*.

With such a configuration, the outside air, having a high density due to its low relative humidity, is introduced into the water tub 20 through the second vent hole 22*a*, to which the relatively high air pressure is applied. Thereby, the interior air of the water tub 20, having a low density due to its high relative humidity, is pushed out by the introduced high density outside air, thereby being discharged to the outside through the first vent hole 21*a* to which the relatively low air pressure is applied. In this way, the outside air is introduced into the water tub 20 and the interior air of the water tub 20 is discharged to the outside to admit natural ventilation in the water tub 20, resulting in a rapid and effective lowering in the relative humidity inside the water tub 20.

In the present invention, it is important that the first vent hole 21*a* is positioned higher than the first end 22*b* of the second connection pipe 22 affixed to the water tub 20 in order to ensure continuous ventilation in the water tub 20. If the first vent hole 21*a* is positioned lower than the first end 22*b* of the second connection pipe 22, it may cause the high density outside air, introduced through the second vent hole 22*a*, to flow directly to the first vent hole 21*a* without circulating in the water tub 20.

Figure 3:
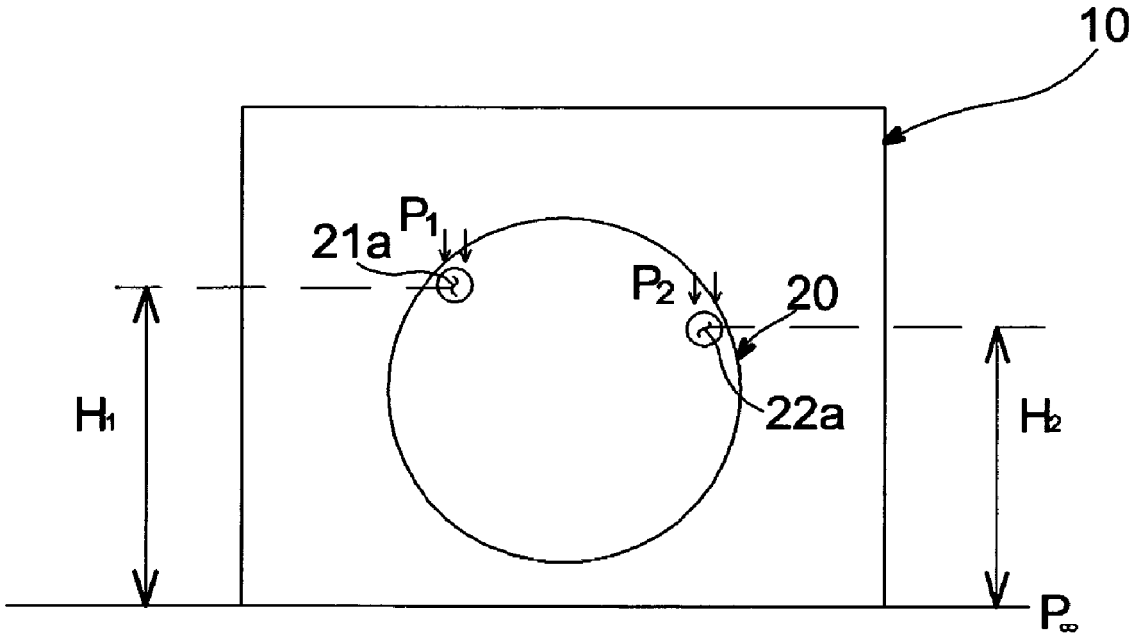
FIG. 3 is a diagram of a drum type washing machine in accordance with another exemplary embodiment of the present invention.

The exemplary embodiment of the present invention as stated above disclosed that the first and second ventilation portions include the first and second connection pipes 21 and 22 having the first and second vent holes 21*a* and 22*a* formed at their second ends, but are not limited thereto, and it is considerable that first and second vent holes 21*a*' and 22*a*' are directly formed at appropriate locations of the water tub 20 as shown in FIG. 3.

Figure 4:
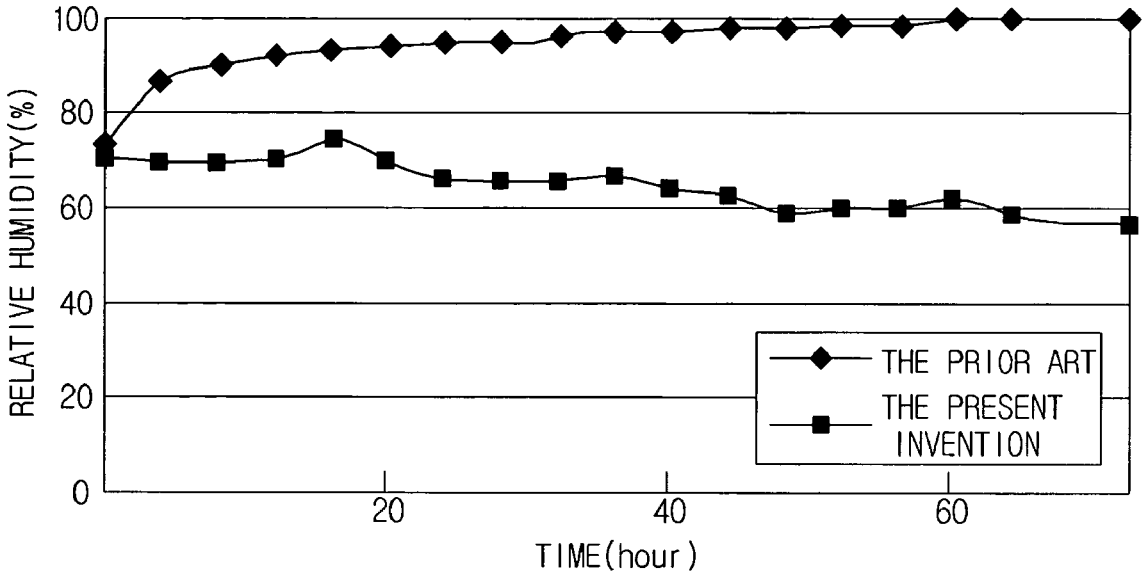
FIG. 4 is a graph illustrating relative humidity according to the passage of time inside a water tub of the drum type washing machine in accordance with the present invention, as compared to a prior art drum type washing machine.

FIG. 4 is a graph illustrating relative humidity according to the passage of time, inside the water tub of the present invention having the first and second vent holes, as compared to a prior art water tub having only one vent hole.

As can be clearly confirmed from FIG. 4, in the case of the prior art water tub having only one vent hole, it exhibits an insufficient inflow or outflow of air via the vent hole, resulting in an increase of the relative humidity inside the water tub as moisture in the water tub evaporates. On the contrary, in the case of the present invention wherein the water tub is provided with a pair of the first and second vent holes at different heights, it ensures smooth circulation of air by virtue of a pressure difference, thereby enabling a rapid lowering of the relative humidity inside the water tub.

As is apparent from the above description, the present invention provides a drum type washing machine capable of effectively lowering a relative humidity inside a water tub within a short time. For this, the present invention suggests that a water tub is provided with a pair of first and second vent holes at different heights to produce a pressure difference. Thereby, if the relative humidity inside the water tub is higher than outside air, outside air can be introduced into the water tub through the second vent hole that is positioned lower than the first vent hole, and interior air of the water tub is discharged to the outside through the first vent hole, thereby allowing the relative humidity inside the water tub to be lowered within a short time by virtue of air circulation.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A drum type washing machine comprising:

a housing;

a water tub mounted in the housing to contain wash water therein, the water tub having an opening formed at a front side of the water tub for accessing laundry to and from the water tub, a rotating tub rotatably mounted in the water tub;

a rotating shaft horizontally mounted at a rear end of the rotating tub;

a water supply pipe installed at a top of the housing for receiving wash water from an external water supply source;

a detergent container installed at the top of the housing for containing detergent and mixing a detergent with the wash water supplied via the water supply pipe;

a drainage pump and a drainage hose installed at a bottom of the housing in order to drain wash water to the outside of the housing; and first and second connection pipes extending to the housing, from the water tub to circulate outside air to and from the water tub, wherein first ends of the first and second connection pipes are connected to a circumference of the water tub, second ends of the first and second connection pipes form first and second vent holes, respectively and the first vent hole is positioned higher than the second vent hole, and wherein the first and second connection pipes provide natural ventilation in the water tub to reduce a level of humidity within the water tub without a blower device.

2. The washing machine according to claim 1, wherein the second connection pipe is a suction pipe to introduce outside air into the water tub, and the first connection pipe is a discharge pipe to discharge interior air of the water tub to the outside.

3. The washing machine according to claim 1, wherein the first end of the second connection pipe, connected to the water tub, is positioned lower than the first vent hole.

4. The washing machine according to claim 1, wherein the height difference between the first and second vent holes is in a range of 80 to 120 mm.

5. The washing machine according to claim 1, wherein the diameter of the first and second vent holes is substantially 70 mm.

* * * * *

UNITED STATES PATENT AND TRADEMARK OFFICE

CERTIFICATE OF CORRECTION

PATENT NO. : 7,614,261 B2
APPLICATION NO. : 11/209656
DATED : November 10, 2009
INVENTOR(S) : Oh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 561 days.

Signed and Sealed this

Nineteenth Day of October, 2010

David J. Kappos

David J. Kappos
*Director of the United States Patent and Trademark Office*